United States Patent [19]

Tolksdorf

[11] 4,302,989

[45] Dec. 1, 1981

[54] APPARATUS FOR HOLDING PANELS FOR FASTENING TO A CARRIER FRAMEWORK

[75] Inventor: Reinhold Tolksdorf, Hadamar-Oberweyer, Fed. Rep. of Germany

[73] Assignee: Häfele KG, Nagold, Fed. Rep. of Germany

[21] Appl. No.: 144,429

[22] Filed: Apr. 28, 1980

[30] Foreign Application Priority Data

Aug. 30, 1979 [DE] Fed. Rep. of Germany ..... 2935069

[51] Int. Cl.[3] ..... B25B 7/00

[52] U.S. Cl. ..... 81/5.1 R

[58] Field of Search ..... 81/5.1 R; 269/6, 904

[56] References Cited

U.S. PATENT DOCUMENTS

| | | | |
|---|---|---|---|
| 1,548,143 | 8/1925 | Jones | 81/5.1 R |
| 2,328,271 | 8/1943 | Greene et al. | 81/5.1 R X |
| 3,659,331 | 5/1972 | Drake et al. | 81/5.1 R X |
| 3,825,990 | 7/1974 | Shields | 81/5.1 R X |

*Primary Examiner*—James G. Smith

*Attorney, Agent, or Firm*—Thomas W. Speckman

[57] ABSTRACT

A device for holding panels for fastening to a carrier framework, such as ceiling or wall panels. The device is a clamping device maintained in clamping position on the carrier framework and holding the panels in place for fastening on a vertical or horizontal surface.

8 Claims, 2 Drawing Figures

APPARATUS FOR HOLDING PANELS FOR FASTENING TO A CARRIER FRAMEWORK

BACKGROUND OF THE INVENTION

1. Field of the Invention

This invention relates to a device for holding panels during the fastening of such panels to a carrier framework of cross laths.

In the paneling of ceilings or walls with narrow panels it is often difficult to secure the panels to the framework of cross laths which is usually firmly attached to the ceiling or the wall, so that as a rule two workmen are required for the job. It is therefore no surprise that attempts have been made in the past to come up with implements and devices which would make it possible for one person to fasten panels to a lathwork secured to the ceiling.

2. Description of the Prior Art

Federal Republic of Germany Utility Model No. 74 05 892 proposes supporting elements which are adjustable in height and are adapted to carry a building slab or panel. The supporting elements can be adjusted so that the panel or plate or slab is retained in its fastening position to the lathwork.

However, this prior device requires at least two supporting members which must be continually adjusted. While it is possible for one workman, using these supports, to attach panels to the carrier framework, he is nevertheless required to make comprehensive and time consuming preparations prior to each job, so that as a net result, the advantages obtained by saving the services of a second workman are largely offset by the increased preparatory work required of the single workman. Moreover, this prior device is not suitable for fastening panels to a vertical wall.

Federal Republic of Germany published patent application No. 16 59 475 proposes a device by which a single workman is able to attach a building panel to a carrier structure suspended from a ceiling. This device consists of two parallel rails which serve as a guide for the tool or implement used to drive the fastening means. These guide rails extend over the entire width of the building slab or plate and are connected to each end to clamp-like brackets. These brackets, which are shaped to extend partway around the rails of the carrier structure, serve to hang the guide rails on a rail of the carrier structure for the panels.

This known device, however, is not suitable for holding narrow panels to a carrier framework which is directly attached to a ceiling or wall because in this case, the rails of the carrier framework can no longer be embraced by the brackets, and with paneling of narrow panels, a panel is accessible to the holding device only from one side. Moreover, this known holding device is extremely cumbersome due to its size so that working with this device does not tend to make the job any easier.

SUMMARY OF THE INVENTION

It is the object of the invention to provide a device for the purposes described in the foregoing, which is small and compact and which facilitates the holding of a panel in its fastening position to a carrier structure or framework of cross laths which is attached to a ceiling or a wall so that a single workman is able to quickly and efficiently fasten the individual panels to the framework.

This is accomplished according to this invention by a device in the form of pliers or a clamp having two pivotally connected structural elements which are held in closed position by means of a compression spring. The clamp elements in their closed position form a rectangular clamp jaw opening which corresponds to the cross section of the laths. At least one clamp element is provided with an attachment member for holding a panel which extends parallel to the pivot axis of the clamp elements and projects at least from one side of the clamp. The distance from the attachment member to the jaw opening is adjustable. The clamp according to this invention is a lightweight compact tool which can quickly be clamped to the lath framework carrying the paneling so that the attachment member of the clamp is immediately in the correct position with respect to the carrier lathwork. The workman places the panel to be fastened next to the previously fastened paneling on the wall or ceiling and uses a clamp according to the invention to hold the panel in its fastening position. For longer panels, two or more of the clamps of this invention may be used for holding the panel. The particular shape of the clamp jaw opening permits a safe attachment of the clamp to the lathwork, preventing the clamp from being turned or tilted in any way so that the panel will be positively held by the attachment member projecting from the clamp.

Since the cross laths of the carrier framework are usually made of wood and lie snugly against the ceiling or wall, a preferred embodiment of the invention provides for a depth of the clamp jaw opening that is smaller than the thickness of the cross laths, and for the ends of the jaws to terminate in claws having a triangular cross section. Thus, the position of the clamp is always well defined with respect to the inner-side of the lath framework, that is, the surface to which the panel is to be fastened. The grip of the clamp on the wooden lath may be further enhanced by providing the claws with teeth. The serrated claws facilitate penetration into the wood for a firmer grip.

It is important that the two clamp elements are of adequate width, particularly in the region of the jaw opening. This is accomplished according to one embodiment by making the clamp elements in the form of U-shaped stamped and bent members which are rotatably connected with each other by a pivot pin. The side walls of the two clamp elements are nestled into each other in the region of the pivot pin. The leg sections of the U-shaped clamp elements then define the width or jaw capacity of the clamp grasp on the lath.

According to one embodiment of the invention, the compression spring of the clamp is maintained on guide pins which are secured, away from the jaw opening, below the pivot pin in the leg sections of the clamp elements of U-shaped cross section. An adjustment of the distance between the attachment member and the jaw opening is effected according to a simplified embodiment by providing the rod-shaped round attachment or holding member with an eccentric bore for receiving a bearing pin which terminates in an end section of reduced diameter. This terminal section is inserted into holes in the sidewalls of a clamp element and secured therein by a head screw which is screwed into a threaded hole in the front side of the terminal section of the bearing pin. A bushing or bearing sleeve is placed on the terminal section of the bearing pin in a manner as to be freely movable. The attachment member is adapted to be secured to the bearing pin in its adjusted position by means of a head screw insertable into a threaded hole in the bearing pin. Washers are provided between the head screw and the side wall of the clamp element and the bearing, respectively, to enable the head screw to be tightened tightly against the respective surfaces.

The closing position of the clamp is defined according to a particularly advantageous embodiment by the bearing pin being disposed in that clamp element whose side walls in the region of the pivot pin partly extend around the side walls of the other clamp element on the outer side, and the bearing sleeve determines the closing position of the clamp by its abutting action against the side walls of the other clamp element.

BRIEF DESCRIPTION OF THE DRAWINGS

The invention will be described in further detail with reference to the accompanying drawings showing preferred embodiments in which.

DESCRIPTION OF THE PREFERRED EMBODIMENTS

Figure 1:
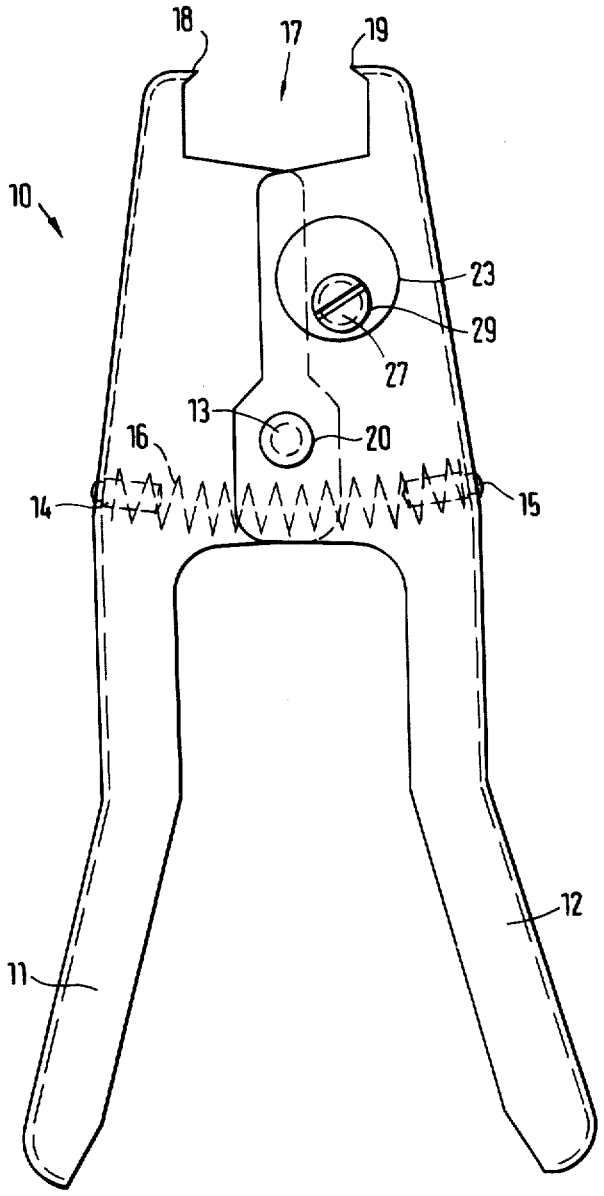
FIG. 1 is a front view of the clamping device of the invention, showing the two pivotally connected clamp elements and the particular shape of the jaw opening.
Figure 2:
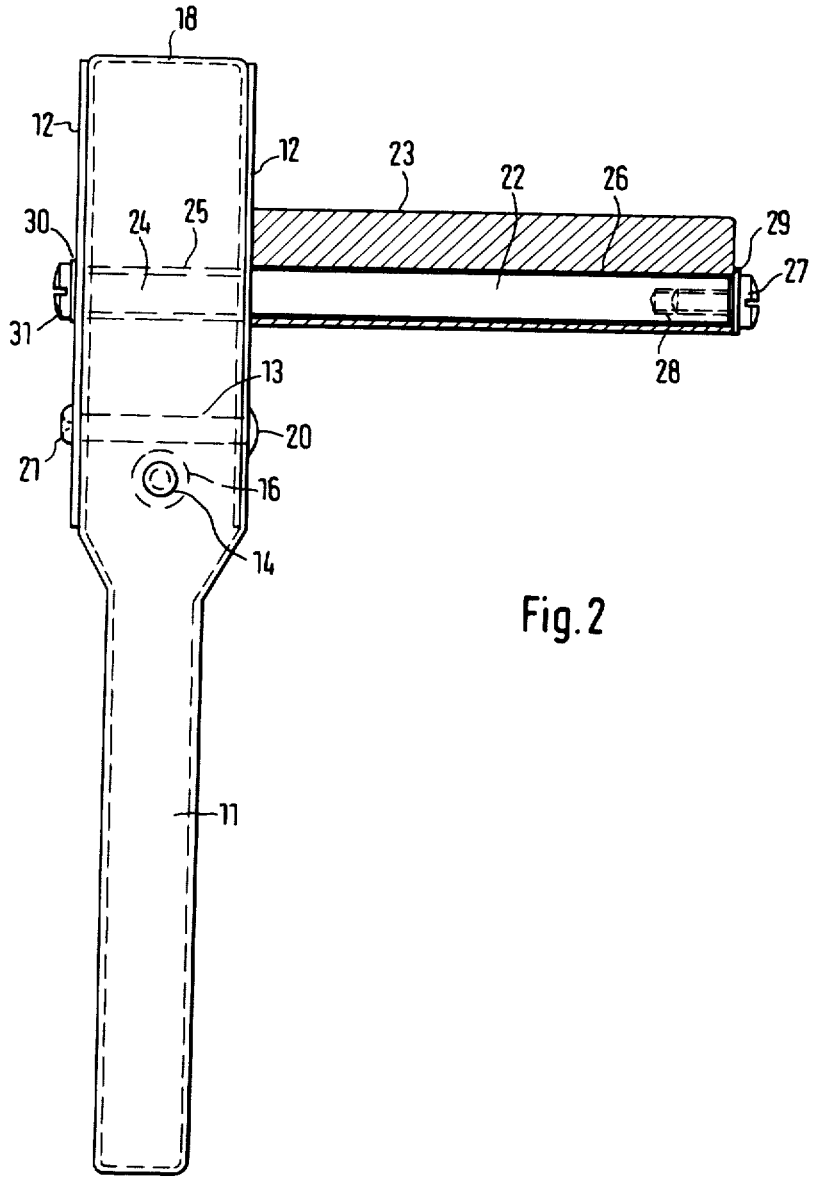
FIG. 2 is a side view, showing the attachment member which is adjustable as to its distance from the jaw opening.

Referring to the figures, plier or clamp 10 comprises two structural elements 11 and 12 which are stamped and bent parts and are U-shaped in cross section.

The side walls of clamp element 12 extend in part around the side walls of clamp element 11, on the outside, in the region of pivot pin 13 which is adapted to be readily insertable through congruent holes in the side walls of the two clamp elements 11 and 12. Pivot pin 13 is securely held in place by its head 20 and the riveted end section 21. Below this pivot axis for the two clamp elements 11 and 12, guide pins 14 and 15 are provided in the leg or handle sections of clamp elements 11 and 12, respectively. These guide pins may be riveted in reduced diameter holes provided in the clamp elements 11 and 12. Secured to guide pins 14 and 15 is compression spring 16 for spreading clamp elements 11 and 12 apart to effect the illustrated closing position of the clamp. Above their pivot axis, clamp elements 11 and 12 terminate into jaws forming a rectangularly shaped opening 17, the cross section of which is adapted to accommodate the cross section of the wooden laths. The jaw-like extensions of the clamp elements 11 and 12 terminate in claw-like projections 18 and 19 which may have a triangular cross section and may be serrated. Due to the tension action of the compression spring 16, the claws 18 and 19 lock around the wood of the cross laths. The depth of the jaw opening is smaller than the thickness of the cross laths so that the clamp 10 will always be attached to the lath framework in a defined position. Disposed in the side walls of the clamp element 12, between pivot pin 13 and the jaw opening, is bearing pin 22 having a terminal section 24 of reduced diameter. This terminal section 24 is provided at its front end with a threaded bore, not shown, adapted to receive the head screw 31. Disposed between the head of the screw 31 and the side wall of the clamp element 12 is washer 30 against which the head of the screw 31 is pressed tightly to thereby firmly retain bearing pin 22 against clamp 10. Between the side walls of clamp element 12, bearing sleeve 25 is freely rotatably disposed on the terminal section 24 of the bearing pin 22. This bearing sleeve or bushing 25 will abut the side walls of the clamp element 11 and thus define the closing position of the clamp 10.

The attachment or holding member 23 itself is a section of a round rod-shaped member provided with eccentric bore 26 to receive pin 22. At its front end, pin 22 is provided with a threaded bore 28 into which is screwed head screw 27. Upon tightening, the head of the screw 27 presses tightly against washer 29 and thus against the pin 22 and the attachment member 23. If screw 27 is loosened somewhat, holding member 23 may be rotated on the pin 22 to adjust the distance between holding member 23 and the jaw opening 17. This means that holding member 23 can be adjusted to fit the thickness of the panel to be fastened to the frame in order to be in the correct fastening position when clamp 10 is applied to the carrier framework. Tightening screw 27 results in the holding member 23 being locked in its adjusted rotary position.

As will be seen from the exemplary embodiment of the invention, the device is compact and handy so that it can readily and quickly be applied to a paneling framework for the purpose of holding a panel to be fastened thereto. Even if longer panels are being held by two or more of the devices of the invention, the job for one workman is no more involved, and only minimal preparation time is required to attach the inventive clamp to the paneling framework.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A device for holding panels for fastening to a carrier framework, characterized in that it is comprised of two pivotally connected clamp elements (11, 12) which are maintained in clamping position by means of a compression spring (16), said clamp elements (11, 12) having jaws which in said clamping position form a generally rectangular clamp opening (17) corresponding in shape to the cross section of the cross laths of said carrier framework, and that a holding member (23) extending generally parallel to the pivot axis of said clamp elements (11, 12) is provided on at least one clamp element and projects at least from one side of said clamp element for holding said panels, the distance from said holding member (23) to said clamp opening (17) being adjustable.

2. A device according to claim 1, characterized in that the depth of said generally rectangular clamp opening formed by said jaws is less than the thickness of said cross laths of said carrier framework, and that said jaws forming said generally rectangular clamp opening terminate in claws of triangular cross section.

3. A device according to claim 2, characterized in that said claws of triangular cross section are provided with teeth.

4. A device according to claim 1 or 2 or 3, characterized in that pivotally connected clamp elements consist of U-shaped stamped and bent members and said clamp elements are pivotally connected by a pin, with side walls formed by said U-shaped members being nestled into each other in the region of said pivot pin.

5. A device according to claim 1, characterized in that said pivotally connected clamp elements consist of U-shaped stamped and bent members and said clamp elements are pivotally connected by a pin, with said walls formed by said U-shaped members being nestled into each other in the region of said pivot pin and said compression spring is secured on guide pins in the handle sections of said U-shaped clamp elements disposed on the side of said pivot pin away from said rectangular clamp opening.

6. A device according to claim 1, characterized in that said holding member is rod-shaped and provided with an eccentric bore holding a bearing pin, said bearing pin terminating in one end section of reduced diameter which is inserted into holes in the side walls of one of said clamp elements and retained therein by means of a head screw which is screwed into a threaded hole in the end of said end section of reduced diameter, a bearing sleeve is freely rotatably disposed on said end section of reduced diameter of said bearing pin, and that said rod-shaped holding member is secured in rotary relation surrounding said bearing pin exterior to said clamp element by means of a head screw screwed into a threaded hole in the other end of said bearing pin.

7. A device according to claim 6, characterized by having a washer under the head of each of said screws to enable the heads of said screws to press tightly against the side wall of said clamp element at one end and said bearing pin and said holding member at the other end.

8. A device according to claim 6 or 7, characterized in that said bearing pin is disposed in one of said clamp elements whose said side walls in the region of said pivot pin partly extend around side walls of the other said clamp element, and that said bearing sleeve determines the closing position of said clamp elements by its abutting against said side walls of said other clamp element.

* * * * *